US006189891B1

(12) United States Patent
Tomita et al.

(10) Patent No.: US 6,189,891 B1
(45) Date of Patent: Feb. 20, 2001

(54) GAS TURBINE SEAL APPARATUS

(75) Inventors: Yasuoki Tomita, Takasato; Kazuharu Hirokawa, Takasago; Hiroki Fukuno, Takasago; Kiyoshi Suenaga, Takasago; Yukihiro Hashimoto, Takasago; Eisaku Ito, Takasago, all of (JP)

(73) Assignee: Mitsubishi Heavy Industries, Ltd., Tokyo (JP)

( * ) Notice: Under 35 U.S.C. 154(b), the term of this patent shall be extended for 0 days.

(21) Appl. No.: 09/028,664

(22) Filed: Feb. 24, 1998

(30) Foreign Application Priority Data

Mar. 12, 1997 (JP) ..... 9-057534

(51) Int. Cl.[7] ..... F16J 15/447
(52) U.S. Cl. ..... 277/414
(58) Field of Search ..... 277/412, 414, 277/416; 415/173.5, 173.6, 173.7, 174.5

(56) References Cited

U.S. PATENT DOCUMENTS 3,761,200 * 9/1973 Gardiner .
4,645,424 * 2/1987 Peters .
4,659,289 * 4/1987 Kalogeros .
4,743,164 * 5/1988 Kalogeros .
5,352,087 * 10/1994 Antonellis .
5,429,478 * 7/1995 Krizan et al. .
5,503,528 * 4/1996 Glezer et al. .
5,536,143 * 7/1996 Jacala et al. .
5,601,404 * 2/1997 Collins .

* cited by examiner

*Primary Examiner*—Anthony Knight
*Assistant Examiner*—John L. Beres
(74) *Attorney, Agent, or Firm*—Wenderoth, Lind & Ponack, L.L.P.

(57) ABSTRACT

A gas turbine seal structure provided between end portions of a moving blade platform and a stationary blade inside shroud. The sealing performance of the seal structure is improved by increasing the resistance to the flow of air. A seal plate (21, 31) is mounted to an end portion of a platform (2, 2') of the moving blade (1) and a seal portion is formed by seal fins (22, 32) and a honeycomb seal (16, 17) disposed on a lower surface of an end portion (**12*a*, 12*b*) of an inside shroud (12) of a stationary blade (11). Sealing air from the stationary blade (11) produces a high temperature in a cavity (14) and flows into a space (18, 19), and also air leaking from the cooling air of the moving blade (1) is able to escape into a high temperature combustion gas passage through a seal portion. However, since the seal plate has three seal fins (22, 32**) that are inclined in a direction so as to oppose the air flow, air resistance is increased and the flow of air into the combustion gas passage is prevented.

4 Claims, 4 Drawing Sheets

GAS TURBINE SEAL APPARATUS

BACKGROUND OF THE INVENTION

1. Field of the Invention

The present invention relates to a gas turbine seal apparatus for preventing cooling air from leaking into a high temperature combustion gas passage between an end portion of a moving blade platform and a stationary blade inside shroud.

2. Description of the Related Art

FIG. 4 is a cross sectional view which shows a seal apparatus for preventing cooling air from leaking between a moving blade and a stationary blade of a conventional gas turbine. In the drawing, reference numeral 1 denotes a moving blade, reference numeral 2 denotes a platform thereof, and reference numeral 3 denotes a seal pin inserted between the adjacent platforms in a circumferential direction and constituted by a seal pin 3*a* extending in an axial direction and a seal pins 3*b* provided on both sides in an inclined manner. Reference numeral 4 denotes a shank portion disposed below the platform 2, reference numeral 5 denotes a disc, and reference numerals 6 and 7 denote seal plates for sealing opposite sides of the shank portion 4.

Reference numeral 11 denotes a stationary blade, reference numeral 12 denotes an inside shroud, and reference numeral 13 denotes an outside shroud. Reference numeral 14 denotes a cavity disposed below the inside shroud 12, reference numeral 15 denotes a seal box, and reference numerals 16 and 17 denote honeycomb seals mounted on front and rear end portions 12*a*, 12*b* of the inside shroud 12. The honeycomb seals 16, 17 are structured such that a plurality of honeycomb cores are disposed in such a manner as to be open downward. Reference numerals 18 and 19 each denote a space formed by the seal plates 6 and 7 of the moving blade 1 and the adjacent stationary blade 11, and these spaces are areas where high air pressure is formed.

In the structure of the moving blade and the stationary blade mentioned above, cooling air is introduced to the moving blade 1 from the disc 5 through a passage (not shown) by suppling the cooling air from the shank portion 4 to a cooling passage for the moving blade 1. However, the cooling air leaks from a contact portion between the seal pins 3*a* and 3*b* or a gap between the platforms adjacent to the end portions 2*a* and 2*b* of the platform 2, and the air directly flows out to the spaces 18 and 19 or the combustion gas passage. Further, since air for the stationary blade 11 leaks from the cavity 14 through the seal box 15, the spaces 18 and 19 are under high pressure. The end portions 2*a* and 2*b* of the platform 2 in the moving blade 1 and the honeycomb seals 17 and 16 provided on the inside shroud 12 of the stationary blade 11 are opposed to each other so as to form the seal mechanisms. The seal mechanisms are intended to prevent more than the necessary amount of cooling air from leaking into the high temperature combustion gas passage and being wasted.

As mentioned above, the seal between the moving blade platform and the stationary blade inside shroud end portion in the conventional gas turbine is constructed as shown in FIG. 4 such that the seals are formed between the honeycomb seals 16 and 17 provided on both ends 12*a* and 12*b* of the inside shroud 17 in the stationary blade 11 and the end portions 2*b* and 2*a* of the moving blade platform 2. Thereby sealing the air which is going to escape into the high temperature combustion gas passage. However, in this seal mechanism, the end portions 2*a* and 2*b* of the platform 2 have a simple shape in comparison with the honeycomb seals 17 and 18, and thus the sealing performance is not always good, so that the seal is insufficient. Accordingly, more than the necessary amount of the sealing air tends to leak into the high temperature combustion gas passage, so that the amount of cooling air is increased, thereby inviting deterioration in the performance of the gas turbine.

In the seal mechanisms, as the flow passage becomes complex and the resistance is increased, the leakage of air is reduced and the sealing performance is improved. However, in the honeycomb seals 16 and 17, the air goes in and out through an inner portion of a multiplicity of honeycomb cores, and the flow becomes complex and the resistance to the flow is increased so as to provide a sealing effect. In contrast, the end portions 2*a* and 2*b* of the platform 2 have a simple shape so that the effect of the flow resistance is not adequately obtained. Accordingly, there is room for improving the current seal mechanism.

SUMMARY OF THE INVENTION

Accordingly, a first object of the present invention is to provide a gas turbine seal apparatus structured such that a shape of a moving blade side seal mechanism is constructed so as to increase flow resistance and enhance the sealing performance in order to improve the sealing performance between a moving blade platform and a stationary blade inside shroud, thereby reducing the amount of cooling air leaking into the high temperature combustion gas and preventing the performance of the gas turbine from deteriorating.

Further, a second object of the invention is to make the seal apparatus in a form which can be integrally manufactured so as to be easily processed and mounted, in the seal apparatus having an improved sealing performance mentioned above.

The invention provides the following (1) and (2) means, respectively, for achieving the first and second objects mentioned above.

(1) A gas turbine seal apparatus in which a seal plate is provided in an inner portion of a moving blade platform of a moving blade, which is disposed in a periphery of a rotating shaft. A platform end portion, to which an upper portion of the seal plate is connected, and a honeycomb seal, provided on an inside shroud end of a stationary blade disposed adjacent to the moving blade, are opposed to each other. Also, a space formed by the seal plate of the moving blade and the adjacent stationary blade is sealed from a combustion gas passage. Furthermore, a plurality of seal fins are provided on an upper portion of the seal plate and are arranged in such a manner so as to oppose a honeycomb seal surface. The seal fins are each inclined in such a manner so as to oppose the flow of air flowing out toward the combustion gas passage. Also, an inclined angle of each of the seal fins is set to $0<\theta\leqq 90°$ where an angle with respect to the honeycomb seal surface is $\theta$.

(2) A gas turbine seal apparatus, as recited in item (1) above, in which the seal plate and the seal fins are integrally formed.

In the structure of the present invention, a plurality of seal fins, opposing the honeycomb seal provided on the inside shroud of the stationary blade, are provided on the upper portion of the seal plate disposed in the inner portion of the platform of the moving blade. Since these seal fins are inclined in a direction against the outflow of air, the air flow is brought into contact with the plurality of seal fins in addition to the flow resistance in the inflow and outflow within the core of the honeycomb seal, so that the flow is disturbed and the resistance is provided, thereby increasing the flow resistance. Accordingly, in comparison with the simple seal structure at the extension portion of the conventional moving blade end portion, the air cannot easily flow out. Since a plurality of seal fins are disposed along the honeycomb seal surface, and further are inclined in such a manner so as to oppose the air flow direction, the seal fins are oriented not in the direction of the air flow but in the opposing direction, so that the air flow resistance is further increased and the sealing effect is increased by making it hard to flow in comparison with the conventional structure.

In the structure, described above in item (2), since the seal plate and the seal fins are integrally processed, it is easy to manufacture them, it is simple to mount them, and further, the complex projecting portion is reduced in the platform to which the seal plate is mounted, so that it becomes easy to form them by precision casting.

BRIEF DESCRIPTION OF THE DRAWINGS

FIGS. 3(A) and 3(B) are front elevational views which show a mounting state of the gas turbine seal apparatus in accordance with the embodiment of the invention, in which FIG. 3(A) shows a case in which one moving blade is provided with one seal plate, and FIG. 3(B) shows a case in which two moving blades are provided with one seal plate.

DETAILED DESCRIPTION OF THE PREFERRED EMBODIMENT

Figure 1:
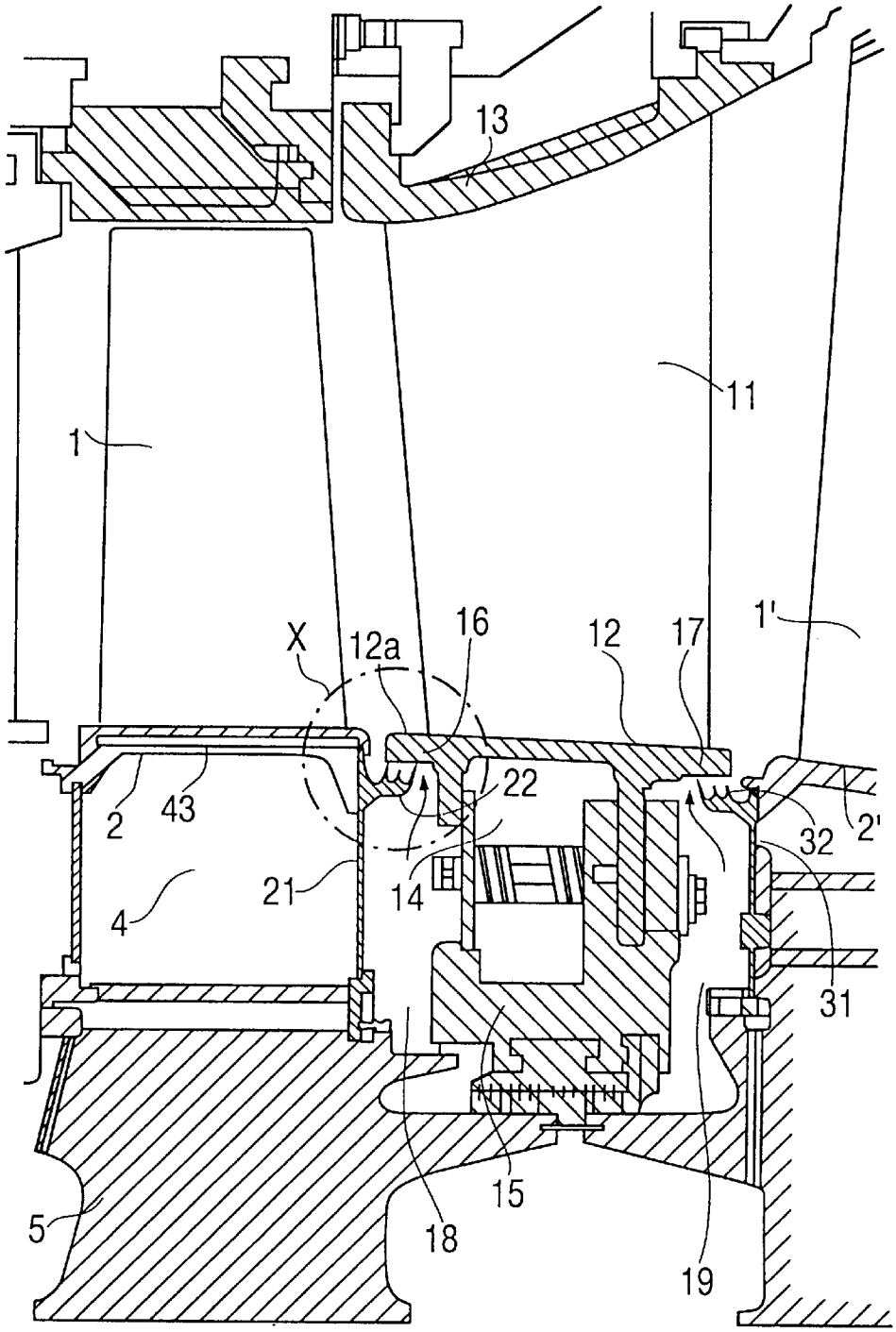
FIG. 1 is a cross sectional view which shows a gas turbine seal apparatus in accordance with an embodiment of the invention.

An embodiment constructed in accordance with the present invention will be described in detail below with reference to the drawings. FIG. 1 is a cross sectional view which shows a gas turbine seal apparatus in accordance with an embodiment of the invention, and FIG. 2 is an enlarged view which shows the details of a seal plate 21 of portion X in FIG. 1.

In FIG. 1, since the structures of the respective blade 11 side have the same function as that of the conventional art, like reference numerals will be used for like components and parts and the detailed description thereof will be omitted. However, the characteristic portion of the invention is the seal plate 21, and thus a detailed description thereof is provided below.

In FIG. 1, the seal plate 21 is mounted to an end of a platform 2 of the moving blade 1 in such a manner so as to extend from a disc 5 to the platform 2 and be in contact with an end portion of a seal pin 43. A plurality of seal fins 22 (three fins in the embodiment shown in the drawings) are provided on an upper portion of the seal plate 21 so as to oppose a surface of a honeycomb seal 16 provided on an end portion 12*a* of an inside shroud 12 of the stationary blade 11. Further, a seal plate 31 having seal fins 32 is provided on a moving blade 1' disposed on a downstream stage side of the stationary blade 11 in the same manner.

Figure 2:
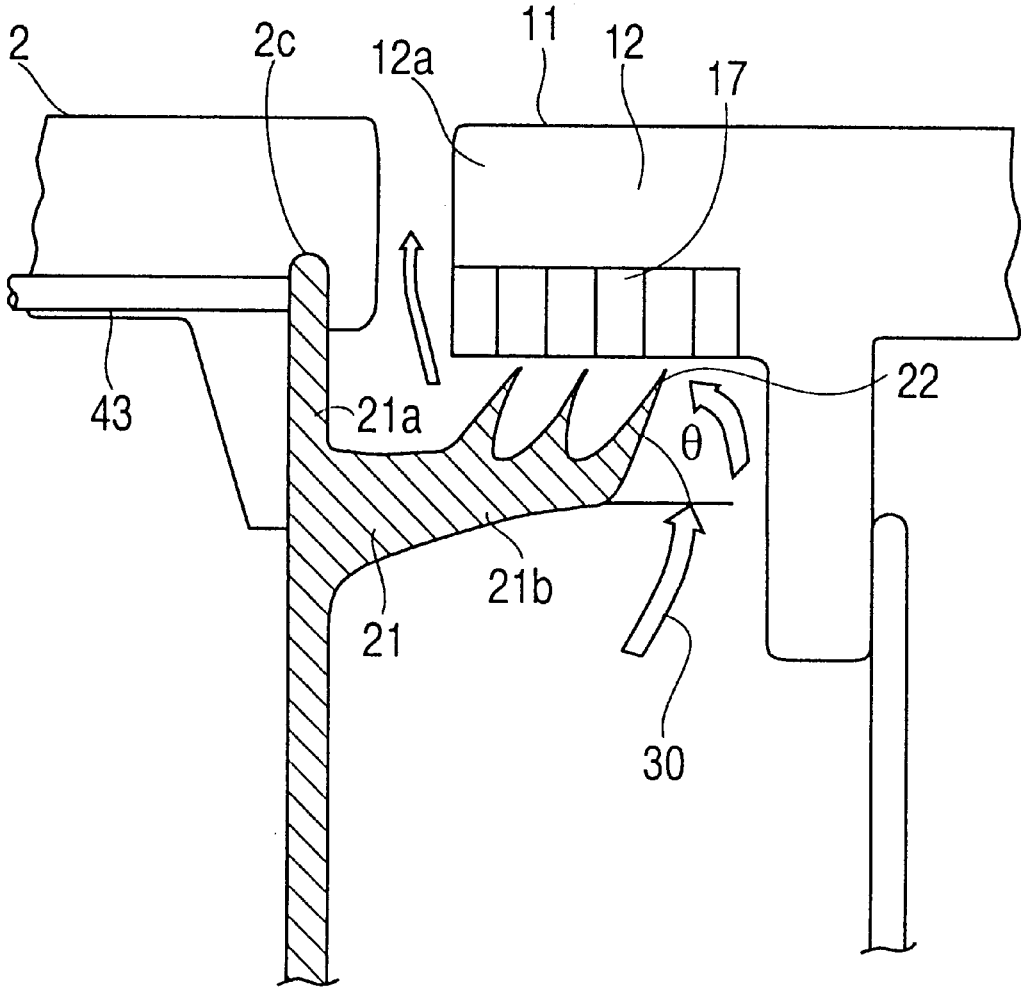
FIG. 2 is an enlarged view of portion X in FIG. 1.

FIG. 2 is an enlarged view which shows the details of the seal plate 21 described above. A terminal end 21*a* of the seal plate 21 is inserted into a recess 2*c* defined in the platform 2 and a seal pin is extended more than the conventional seal pin 3 so as to form a seal pin 43. The terminal end 21*a* of the seal plate 21 is in contact with the terminal end of the seal pin 43, thereby removing the gap at this portion and preventing the air from leaking. A projecting portion 21*b* is provided on the upper portion of the seal plate 21, and three seal fins 22 are formed so as to oppose the honeycomb seal 17 disposed on a lower surface of the end portion 12*a* of the inside shroud 12 of the stationary blade 11.

The seal fins 22 are inclined so as to oppose the flow direction of an air flow 30, and it is sufficient to set an inclined angle of the fins to be within a range of $0<\theta\leqq 90°$, so that the sealing effect can be increased. Since the angle of the each of the seal fins 22 is not inclined in the direction of the air flow but are inclined in a direction opposing the air flow, the flow is prevented by a side surface of the seal fin and the flow resistance is increased.

Figure 4:
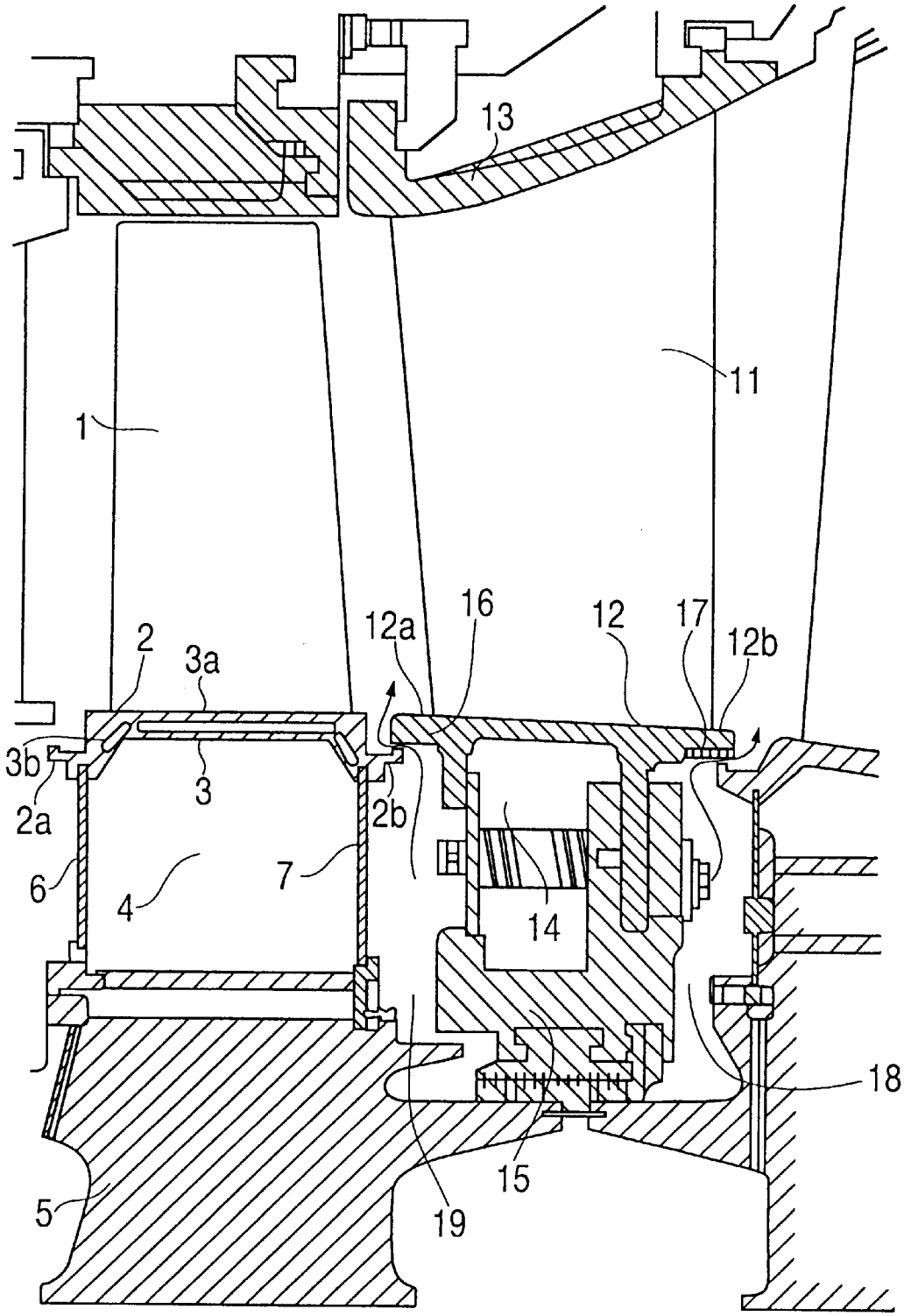
FIG. 4 (PRIOR ART)
FIG. 4 is a cross sectional view which shows a seal structure of a conventional gas turbine.

In this case, the flow resistance provided by the seal fins 22 increases when the seal fins are made taller and the number thereof is increased. However, a sufficient effect can be obtained when the number of seal fins is three as the number is restricted by the structure of the moving blade and the stationary blade in the gas turbine. Further, the seal plate 21 is provided in place of the conventional seal plates 6 and 7 shown in FIG. 4. The seal plates 21 of the present invention can be formed integrally so as to facilitate the processing and the mounting thereof.

Further, the seal plate 31, provided on the moving blade 1' on the downstream stage side of the stationary blade 11, has basically the same structure as that of the seal plate 21. However, the direction of inclination of the seal fins 32 of the seal plate 31 is set so as to be opposite to the inclination of the seal fins 22 of the seal plate 21 for the purpose of being inclined in a direction which is opposite to the air flow.

Figure 3A:
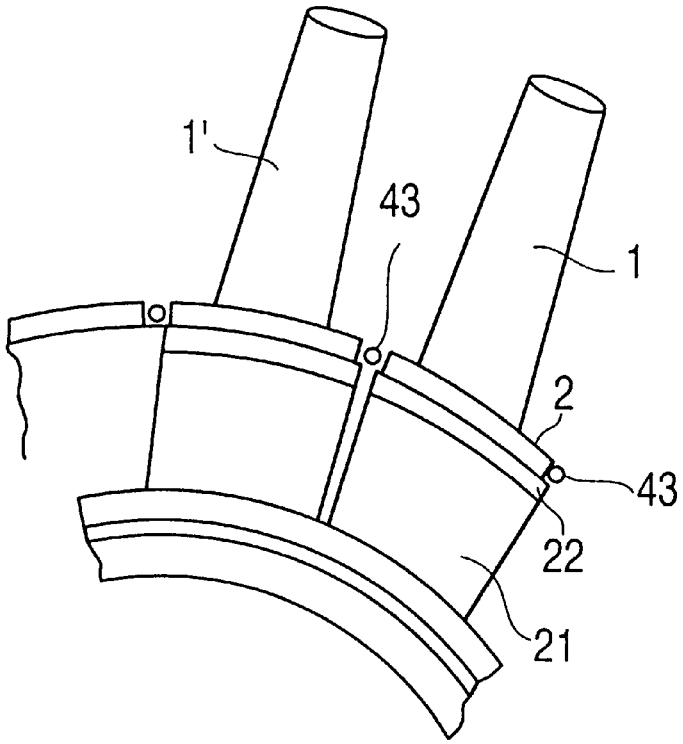

FIG. 3A is a front elevational view as seen from an axial direction which shows the seal plate 21 mounted to the moving blade 1. The seal plate 21 is mounted to the moving blade 1 in the circumferential direction in such a manner so that one seal plate 21 is mounted to a side surface of one moving blade 1, as shown in FIG. 3(A).

Figure 3B:
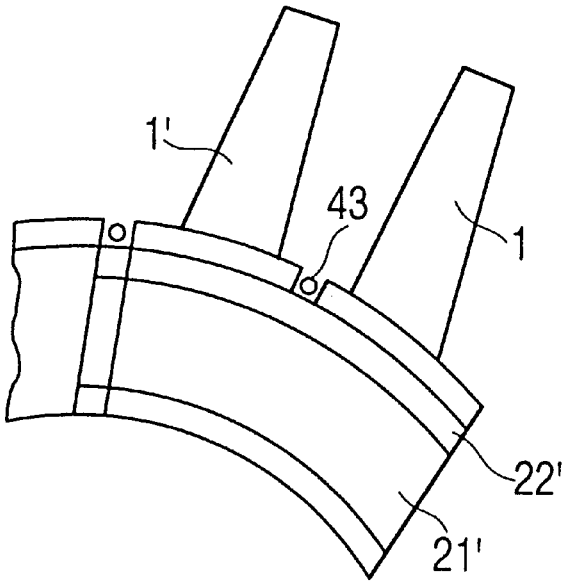

The seal plate may also be mounted to the side surface of more than one moving blade so that a single seal plate 21' is mounted to two moving blades 1 and 1' or one sealing plate is mounted to a plurality of moving blades, as shown in FIG. 3(B). In the structure in which one seal plate 21 is provided with respect to each of the moving blades as shown in FIG. 3(A), the leakage of the sealing air occurs at the connecting portion with respect to the adjacent seal plates 21. However, in the structure in which one seal plate 21' is provided with respect to a plurality of moving blades 1 and 1' as shown in FIG. 3(B), the number of connecting portions between the seal plates 21' is reduced, and thus the amount of air leaking from the connecting portions is reduced. Therefore, the amount of air leakage is reduced by that amount.

As mentioned above, in the gas turbine seal apparatus in accordance with the embodiment, the resistance to the air flow is increased in comparison with the conventional seal structure, and the amount of leaking air is reduced. Further, the amount of air leaking from the gap between the seal pin 43 and the seal plate 21 is also reduced, so that the sealing effect can be further increased when the number of the seal plates 21 is reduced as shown in FIG. 3(B).

Still further, the seal plate 21 can be integrally formed by a separate process, which is advantageous in the processing of the platform 2. That is, since the platform 2 requires precision casting of a hard material, a complex shape is not preferable in processing. However, when the seal plates 21 and 31 are processed separately so as to be assembled later, it is sufficient that the end portions 2*a* and 2*b* of the platform 2 have a simple construction.

While the preferred form of the present invention has been described, variations thereto will occur to those skilled in the art within the scope of the present inventive concepts which are delineated by the following claims.

What is claimed is:

1. A gas turbine seal apparatus comprising a moving blade disposed on a periphery of a rotating shaft, said moving blade having a platform;

a seal pin extending from a first end of said platform to a second end of said platform;

a seal plate having an upper end portion inserted in an inner circumferential portion of said platform so as to contact an end of said seal pin, said seal plate further having an axially projecting portion at said upper end portion, and a plurality of seal fins provided on an upper surface of said axially projecting portion;

a stationary blade disposed adjacent to said moving blade, said stationary blade having an inside shroud; and a honeycomb seal connected to an end portion of said inner shroud so that said honey comb seal overlies said projecting portion of said seal plate so that said seal fins confront an sealing surface of said honeycomb seal, wherein each said seal fins is inclined relative to said projecting portion in a direction so as to oppose a flow of air, and each of said seal fins is inclined at an angle $\theta$ where $0<\theta\leqq 90$ degrees.

2. A gas turbine seal apparatus as claimed in claim 1, wherein said seal plate and said seal fins are integrally formed.

3. A gas turbine seal apparatus as claimed in claim 1, wherein said upper end portion of said seal plate is inserted into a recess defined in said inner circumferential portion of said platform such that a downstream surface of said upper end portion of said seal plate is in contact with an upstream surface of said platform.

4. A gas turbine seal apparatus as claimed in claim 1, wherein said upper end portion of said seal plate is inserted in said inner circumferential portion of said platform such that a downstream facing surface of said upper end portion of said seal plate is in contact with an upstream facing surface of said platform, and the end of said seal pin engages an upstream facing surface of said seal plate.

* * * * *